United States Patent [19]

Ishimaru

[11] 4,111,355

[45] Sep. 5, 1978

[54] MULTI-COMPARTMENT CENTRIFUGE ROTOR LINER

[75] Inventor: Kenzo Ishimaru, San Jose, Calif.

[73] Assignee: Beckman Instruments, Inc., Fullerton, Calif.

[21] Appl. No.: 806,807

[22] Filed: Jun. 15, 1977

[51] Int. Cl.[2] ..... B04B 1/00

[52] U.S. Cl. ..... 233/20 R; 233/43; 233/1 A

[58] Field of Search ..... 233/1 R, 1 A, 19 R, 233/20 R, 26, 37, 46, 40, 43

[56] References Cited

U.S. PATENT DOCUMENTS

| | | | |
|---|---|---|---|
| 3,810,576 | 5/1974 | Polson et al. | 233/37 |
| 3,901,434 | 8/1975 | Wright | 233/27 X |
| 4,056,225 | 11/1977 | Hein | 233/20 R |

*Primary Examiner*—George H. Krizmanich

*Attorney, Agent, or Firm*—Robert J. Steinmeyer; Ferd L. Mehlhoff; William H. May

[57] ABSTRACT

A multi-compartment centrifuge rotor having a sealing element which automatically controls in response to the centrifugation operation the fluid communication between the separate chambers within the rotor. The sealing element is situated within the rotor above an annular and an inner chamber used for containing a fluid mixture. When the rotor is assembled and stationary, the sealing element establishes a seal between the respective chambers. During the rotation of the rotor, centrifugal forces exerted directly on the sealing member cause it to move and release the seal between the respective chambers to allow fluid communication between the chambers. As the rotor returns to a stationary position and the centrifugal forces induced on the sealing member subside, the sealing element automatically re-establishes the seal between the respective chambers.

4 Claims, 4 Drawing Figures

MULTI-COMPARTMENT CENTRIFUGE ROTOR LINER

BACKGROUND OF THE INVENTION

This invention relates generally to centrifuges for separating constituents of a fluid mixture and, more specifically, relates to a centrifuge rotor which provides for the automatic isolation of the centrifugated constituents of the liquid mixture in a sealed chamber to prevent possible remixing subsequent to the centrifugation operation.

By exposing certain fluid mixtures to very high speeds of rotation in a centrifuge rotor it is possible to separate out various constituents of the mixture. An incident problem with the centrifugation operation, especially with air driven centrifuges, relates to the possible remixing of the various separated constituents during the time that the rotor is decelerating to a complete stop from its high rotational speed. Consequently, various arrangements have been devised such as shown in U.S. Pat. Nos. 3,239,136 and 3,096,283 issued to George N. Hein for sealing the separated fluid constituents in an annular chamber. A further example of sealing the separated fluid constituents in an annular chamber is shown in the pending patent application entitled Centrifuge Rotor for Separating Phases of a Liquid, invented by George N. Hein, Jr. and having Ser. No. 681,312, filed on Apr. 29, 1976.

As shown in the first two above referenced patents, the arrangements utilized to accomplish the sealing function are quite complicated and contribute to a more costly device. Further, the prior art arrangements do not operate automatically in response to the centrifugation operation to provide an automatic sealing and unsealing of the annular chamber. These devices require an operation independent of the centrifugation operation to seal and/or unseal the annular chamber.

The recently filed Ser. No. 681,312 patent application by George N. Hein, Jr. overcomes some of the complicated and costly objections to most of the prior art arrangements.

SUMMARY OF THE INVENTION

The present invention comprises a sealing element which facilitates the automatic opening and closing of a seal between an annular and an inner chamber in the rotor in response to the centrifugation operation. When the rotor is stationary, the sealing element facilitates a seal between the annular chamber and the inner chamber which are part of a container or liner situated within the rotor to contain the fluid mixture to be subjected to centrifugation. When the container with its respective annular and inner chambers containing a fluid mixture is subjected to centrifugation, the sealing element will move in response to centrifugation forces exerted directly on it to release the seal previously established between the annular and inner chambers. Centrifugally induced forces of the fluid mixture will provide for the flow or fluid communication between the respective chambers.

The sealing element holds a thin cover member in sealing engagement with the lower portion of the liner or container when the rotor is stationary. When the rotor is at high speed rotation, the movement of the sealing element away from the sealing junction allows for the fluid mixture to force the thin flexible cover member out of sealing engagement with the lower portion of the container to permit fluid communication between the respective chambers.

Therefore, when the liner has received, for example, a lipemic serum for centrifugation, the chylomicrons will float toward the center or inner chamber and the cleared serum will flow toward the outer edge or annular chamber. As the rotor slows down, the sealing element will return to its original position to re-establish the seal of the thin cover on the lower portion of the liner and maintain the sealed separation between the respective chambers.

The present invention utilizes an uncomplicated and inexpensive design to accomplish the desired automatic sealing and unsealing between the annular and inner chambers of a rotor container.

DETAILED DESCRIPTION OF THE INVENTION

Figure 1:
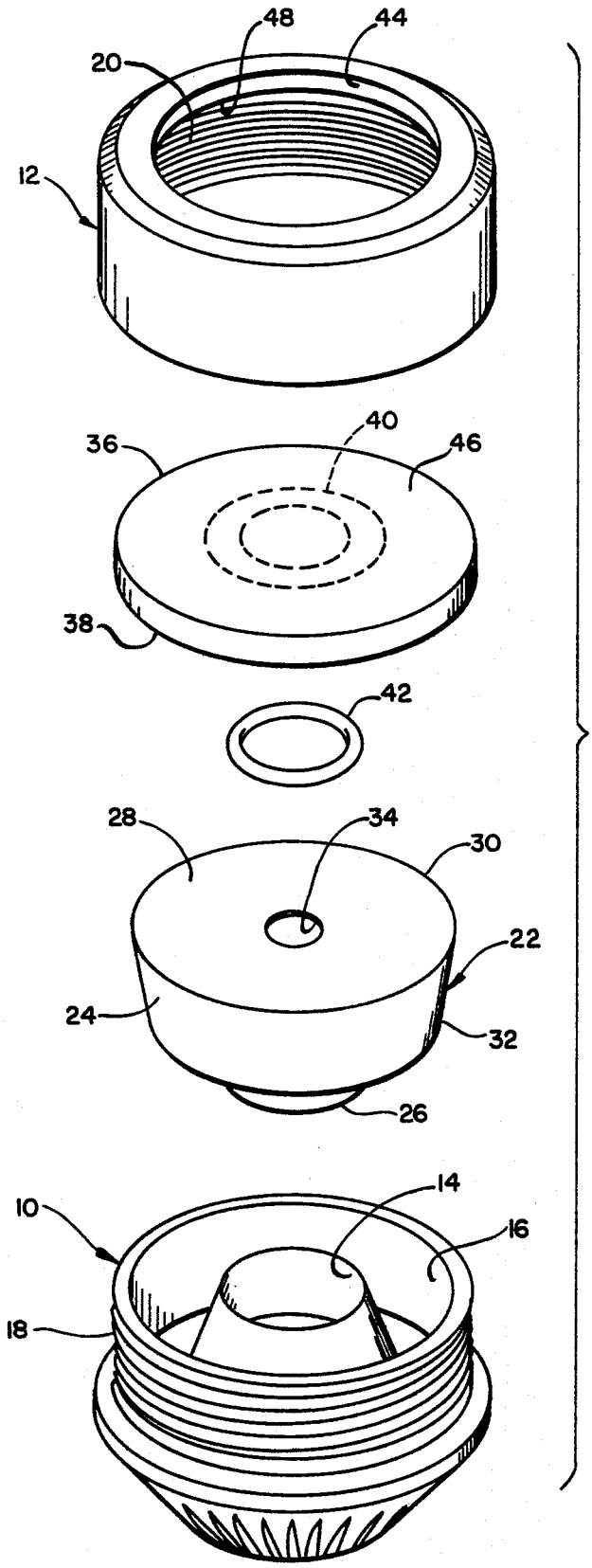
FIG. 1 is an exploded perspective view of the components of the centrifuge rotor of the present invention.

FIG. 1 shows an exploded perspective view of an air driven centrifuge rotor incorporating the present invention. The rotor has a bottom portion 10 and an upper portion or cap 12. The lower portion 10 contains a central recess 14 and a surrounding annular recess 16. The lower half of the rotor 10 has exterior threads 18 which are designed to receive the interior threads 20 on the rotor cap 12. The lower portion 10 of the rotor is designed to receive a rotor liner 22 having an annular chamber 24 and a central inner chamber 26. Positioned over the respective chambers 24 and 26 is a thin membrane cover 28 which is sealed at its periphery 30 to the upper edge of the outer wall 32 of the annular chamber 24. Located within the thin cover 28 is an aperture 34 to allow insertion and extraction of a fluid sample from within the rotor liner as will be explained more fully in the operation of the present invention. Positioned between the rotor liner 22 and the rotor cap 12 is a rigid containment lid or disc 36, having on its lower surface 38 a recessed groove 40. This groove is designed to receive a sealing element or circular O-ring device 42. The retaining lid 36 is designed to rest over the cover 28 on the rotor liner 22.

It should be noted that the rotor cap 12 has an open aperture 44 which exposes a majority of the upper surface area 46 of the retaining lid 36. The rotor cap 12 has a shoulder 48 which is designed to mate on the top surface 46 of the retaining lid 36. Consequently, when the rotor cap 12 is threadably engaged with the lower portion 10 of the rotor, the retaining lid 36 and the liner 22 are securely contained within the rotor.

Figure 2:
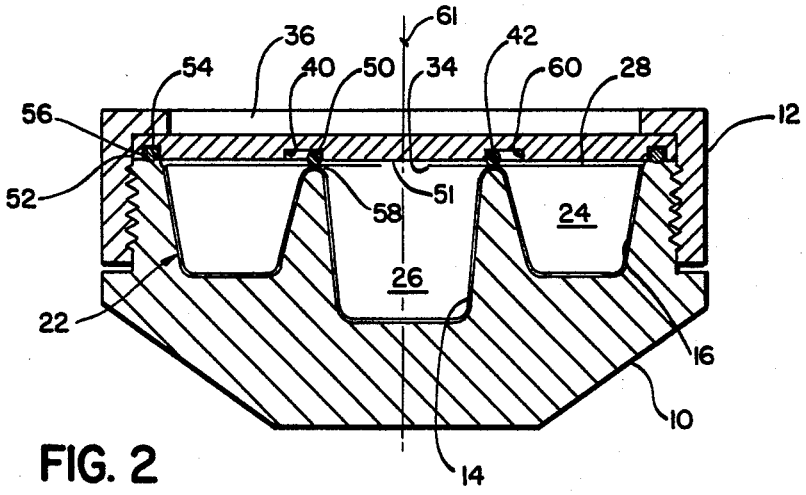
FIG. 2 is a sectional view of the rotor showing the sealed orientation of the respective chambers when the rotor is stationary.

The assembly of the rotor is shown in FIG. 2 with the rotor cap 12 threadably engaged with the lower portion 10 of the rotor. The respective inner chamber 26 and annular chamber 24 are positioned within the central recess 14 and annular recess 16 at the lower portion 10 of the rotor. The retaining lid 36 is in close adjacent contact with the thin flexible cover 28 located on the liner 22. The O-ring 42 is positioned within the circular recess 40. The diameter of the O-ring or sealing element 42 is just slightly larger than the diameter of the inner shoulder 50 of the circular groove 40. The shoulder 50 forms a central post 51 on which the sealing element 42 is positioned.

Located adjacent the outer edge 52 of the retaining lid 36 is a peripheral groove 54 designed to contain a peripheral sealing O-ring 56. Seal 56 is established between the lower portion 10 of the rotor and the retaining lid 36 when the rotor cap 12 is tightly engaged with the rotor bottom 10. Consequently, the seal prevents the escape of any fluid from within the rotor.

Turning to the operation of the present invention, reference is made to FIG. 2 showing the configuration of the rotor and liner with its sealing element 42 in its orientation when the rotor is stationary. Before the assembly of the rotor, lipemic serum is loaded into the respective annular and inner chambers 24 and 26 through the central aperture 34 in the cover 28. The retaining lid 36 is then positioned over the liner 22 and the rotor cap 12 is threadably secured to the lower portion 10 of the rotor to provide a tight engagement between the respective rotor cap 12 and lower portion 10 of the rotor. This will provide a seal by the O-ring 56 between the rotor cap 12 and the lower portion 10 of the rotor. In the stationary position the sealing element 42 is located at the walled junction 58 and establishes a seal of the cover 28 against the walled junction 58 separating the annular chamber 24 and the inner chamber 26.

Figure 3:
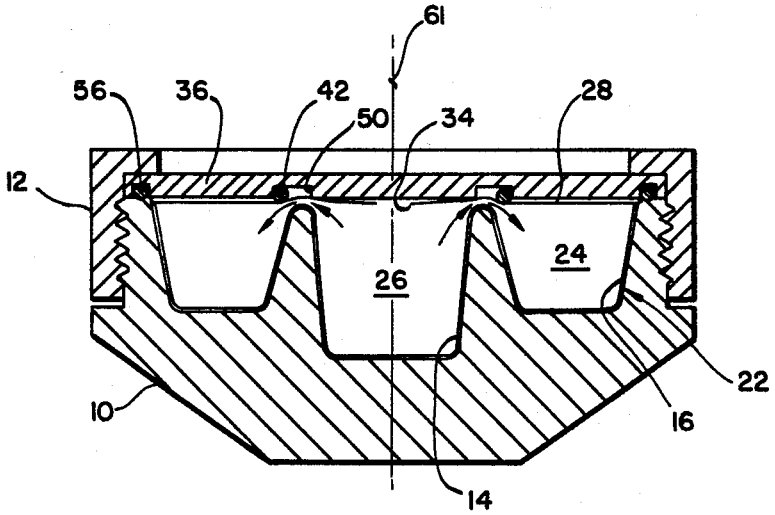
FIG. 3 is a sectional view of the rotor similar to FIG. 2, showing the seal between the respective chambers opened to allow fluid communication between those chambers during centrifugation of the rotor.

When the rotor is subjected to centrifugation, the centrifugal forces acting directly on the sealing element 42 cause it to move radially outward within the groove 40 so that it moves adjacent the outer shoulder 60 of the groove 40. Consequently, the thin membrane cover 28 is free to flex under the forces of the fluid mixture as the fluid mixture attempts to move between the respective inner and outer chambers 26 and 24. As shown in FIG. 3, the membrane cover is deflected away from the walled junction 58 to allow fluid communication between the chambers. Because the sealing element 42 is a uniformly made member and because it is concentrically located about the spin axis 61, it will expand radially outward in a uniform manner.

Once the centrifugation run has been completed and the rotor decelerates, the sealing element 42 will return to its original position as shown in FIG. 2, sealing the cover 28 against the wall junction 58. A seal is re-established between the annular chamber 24 and the inner chamber 26 to ensure the maintenance of the cleared serum in the annular chamber 24 separated from the chylomicrons located in the center chamber 26. Consequently, during deceleration when there may be some unstable movement of the rotor, remixing would be prevented.

Figure 4:
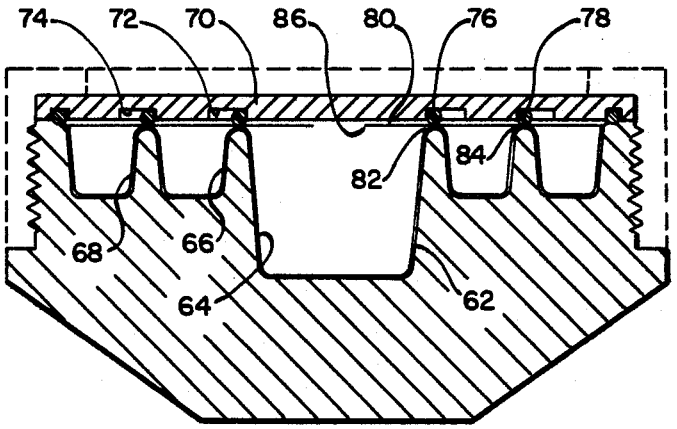
FIG. 4 is a sectional view of an alternate embodiment of the present invention.

Reference is made to FIG. 4 showing an alternate embodiment of the present invention wherein the lower portion of the liner 62 would have a central chamber 64 and two annular chambers 66 and 68. The containment lid 70 would have two travel grooves 72 and 74, respectively, to provide a path for the respective sealing elements 76 and 78.

The operation of the alternate embodiment would be the same as that discussed with respect to FIGS. 2 and 3, wherein during centrifugation the sealing elements 76 and 78 would move radially outward and permit fluid communication between the respective chambers 64, 66 and 68. Once the centrifugation run had been completed, the sealing elements 76 and 78 would return to their positions shown in FIG. 4 and establish a seal between the membrane cover 80 and the respective wall junctions 82 and 84 to seal the chambers from each other.

If a sample such as whole blood were inserted through the aperture 86 in the cover 80 for placement within the inner chamber 64 as well as the annular chambers 66 and 68, the blood cells would move to the outer annular chamber 68 during centrifugation while the buffy coat would move to the first annular chamber 66 and the serum would be in the inner chamber 64. Once the centrifugation process were completed and the rotor returns to its stationary orientation, the sealing elements 76 and 78 would re-establish the seal between the respective chambers, so that there would be no remixing of the constituents after the centrifugation run.

It is envisioned that other embodiments of the present invention could be utilized and still fall within the scope of the invention directed to a multi-compartment rotor liner.

What is claimed is:

1. A centrifuge rotor comprising:

a lower portion of said rotor;

a liner member located within said lower portion of said rotor, said liner member having at least two compartments;

a thin membrane cover overlying said compartments;

a rigid disc member positioned over said membrane cover to cause said membrane cover to seal one of said compartments from the other of said compartments;

a rotor lid to secure said disc over said membrane cover and said liner member; and means located within said rigid disc member and directly responsive to centrifugal forces for releasing said membrane from its sealing engagement with said one of said compartment to allow fluid communication between said compartments during centrifugation.

2. A centrifuge rotor as defined in claim 1, wherein said releasing means comprises an elastic ring member positioned on a central post within an annular recessed area in the lower surface of said rigid disc member, said recessed area being larger than said ring to allow said ring to expand radially outward during centrifugation and permit said membrane to flex upward under the centrifugally induced forces of a fluid sample in said liner to provide fluid communication between said compartments.

3. A centrifuge rotor as defined in claim 1 wherein said liner member has at least three compartments and additionally comprises a second releasing means adjacent the junction between said other compartment and the third compartment.

4. A centrifuge rotor comprising:

a lower section of said rotor;

a container positioned within said lower section of said rotor;

at least two compartments in said container;

a flexible cover secured to said container;

a lid of said rotor removably engaged with said lower section of said rotor; and means within said lid for holding said cover in a first position to seal one of said compartments from the other, said holding means during rotation of said rotor shifting its relative position respect to said cover by centrifugal forces on the weight of said holding means to allow said cover to move to a second position to permit fluid communication between said compartments.

* * * * *